US011268236B2

(12) United States Patent
Damour et al.

(10) Patent No.: US 11,268,236 B2
(45) **Date of Patent: *Mar. 8, 2022**

(54) ITEM INCLUDING A LAMINATED, METALLIZED TEXTILE LAYER, IN PARTICULAR FOR SUN PROTECTION, AND METHOD FOR GRAFTING A METAL LAYER IN ORDER TO OBTAIN SAID ITEM

(71) Applicant: MERMET, Veyrins-Thuellin (FR)

(72) Inventors: François-Xavier Damour, Lyons (FR); Alain Crouzet, Le Touvet (FR)

(73) Assignee: MERMET, Veyrins-Thuellin (FR)

( * ) Notice: Subject to any disclaimer, the term of this patent is extended or adjusted under 35 U.S.C. 154(b) by 687 days.

This patent is subject to a terminal disclaimer.

(21) Appl. No.: 15/776,429

(22) PCT Filed: Nov. 18, 2016

(86) PCT No.: PCT/FR2016/053022

§ 371 (c)(1),
(2) Date: May 16, 2018

(87) PCT Pub. No.: WO2017/085432

PCT Pub. Date: May 26, 2017

(65) Prior Publication Data

US 2018/0327963 A1 Nov. 15, 2018

(30) Foreign Application Priority Data

Nov. 20, 2015 (FR) ..... 15 61203

(51) Int. Cl.

| | |
|---|---|
| ***D06M 11/83*** | (2006.01) |
| ***D06N 3/18*** | (2006.01) |
| ***D06N 7/00*** | (2006.01) |
| ***D06M 13/513*** | (2006.01) |
| ***D06M 15/248*** | (2006.01) |
| ***D06N 3/00*** | (2006.01) |

(52) U.S. Cl.

CPC ..... *D06M 11/83* (2013.01); *D06M 13/513* (2013.01); *D06M 13/5135* (2013.01); *D06M 15/248* (2013.01); *D06N 3/0063* (2013.01); *D06N 3/183* (2013.01); *D06N 7/0094* (2013.01); *D06M 2200/25* (2013.01); *D06N 2203/048* (2013.01); *D06N 2209/0876* (2013.01); *D06N 2211/125* (2013.01)

(58) Field of Classification Search

CPC ..... D06M 11/83; D06M 13/513; D06M 13/5135; D06M 15/248; D06N 3/0063; D06N 3/183; D06N 7/0094

USPC ..... 442/131

See application file for complete search history.

(56) References Cited

U.S. PATENT DOCUMENTS

| | | | | |
|---|---|---|---|---|
| 4,495,239 | A * | 1/1985 | Pusch | F41H 3/02 428/192 |
| 7,662,474 | B2 | 2/2010 | Conesa et al. | |
| 9,217,816 | B2 * | 12/2015 | Zhang | G02B 5/128 |
| 2014/0113104 | A1 | 4/2014 | Rozant et al. | |
| 2016/0273155 | A1 | 9/2016 | Crouzet et al. | |

FOREIGN PATENT DOCUMENTS

| | | | | |
|---|---|---|---|---|
| CN | 1049124 | A | 2/1991 | |
| CN | 2262068 | Y | 9/1997 | |
| CN | 101641460 | A | 2/2010 | |
| CN | 102574966 | A | 7/2012 | |
| CN | 102965974 | A | 3/2013 | |
| JP | S6274067 | A | 4/1987 | |
| JP | 05009829 | A | 2/1993 | |
| JP | H059829 | B2 * | 2/1993 | G06K 9/00 |
| JP | 2001098464 | A | 4/2001 | |
| JP | 2002-201567 | A | 7/2002 | |
| JP | 20020254577 | A | 9/2002 | |
| JP | 5533774 | B2 | 6/2014 | |
| JP | 2015-511194 | A | 4/2015 | |
| WO | 2013/126739 | | 8/2013 | |
| WO | 2015/071615 | A1 | 5/2015 | |

OTHER PUBLICATIONS

Machine translation of japanese reference (Year: 1993).*
A Common Knowledge Reference—China Chemical Industry Yearbook 2004/2005 (vol. 21).
Application Technologies of Glass Fibres, China Petrochemical Press, Jan. 2004.
Database WPI Week 200150 Thomson Scientific, London, GB; AN2001-459792 XP002767430.
Database WPI Week 200351 Thomson Scientific, London, GB; AN 2003-535561 XP002759641.

* cited by examiner

*Primary Examiner* — Vincent Tatesure
(74) *Attorney, Agent, or Firm* — Workman Nydegger

(57) ABSTRACT

The present invention provides an article, in particular for solar protection, comprising at least one metal-coating layer and a textile layer having an outside face comprising at least one polymer mixed with at least one plasticizer to form a first matrix. Advantageously, the bonding between said first matrix and the metal-coating layer is provided by an intermediate polymer layer comprising at least one coupling polymer, said coupling polymer being bonded by chemical bonds firstly to the first matrix and secondly to the metal-coating layer.

The present invention also provides a method of fabricating such an article including a step of metal coating by depositing metal vapor under reduced pressure.

21 Claims, No Drawings

ITEM INCLUDING A LAMINATED, METALLIZED TEXTILE LAYER, IN PARTICULAR FOR SUN PROTECTION, AND METHOD FOR GRAFTING A METAL LAYER IN ORDER TO OBTAIN SAID ITEM

FIELD

The present disclosure relates to the technical field of articles adapted to providing solar protection, more particularly articles comprising a textile layer having a polymer mixed with at least one plasticizer and covered in a metal layer suitable for providing solar protection, and the disclosure also relates to methods of fabricating such articles.

BACKGROUND

The performance of solar protection articles comprising a textile layer is characterized in particular by thermal indices that characterize the fractions of solar radiation that are transmitted (Ts) and reflected (Rs). The higher the value of Rs, the greater the performance of the sunshade. This Rs value is essentially a function of the outside surface state of the solar protection article. It is generally accepted that Rs values of about 70% represent the maximum values that can be reached for the products currently available on the market.

Another important characteristic of solar protection articles is their fire resistance. Fire behavior is characterized by various standardized tests. In France, fire behavior is evaluated, among other ways, in application of the NFP 92507 standard (in particular dated February 2004) that makes it possible to obtain a classification having "M" levels. For solar protection articles, it is the level M0 or the level M1 that is generally required. European standard EN 13.501-1 (in particular dated February 2013) also serves to define a classification, known under the name EUROCLASSE, for the fire resistance of flexible materials. The desired classification level is A2s1d0. Other classifications specific to a country or to a geographical zone may be required. For example, Germany has a fire classification in application of the DIN 4102 standard. For solar protection fabrics, the required level is generally B1.

At present, the main known technique for obtaining an Rs value in the range 70% to 75% for solar protection articles presenting an openness factor (OF) in the range 2% to 10% is obtained by depositing metal on the outside face of the textile layer. Several technologies enable such metal deposition to be performed:

- Depositing a binder containing a metal filler, in particular based on aluminum. Under such circumstances, the binder, which is of an organic nature, is combustible. Unfortunately, that technique leads to high levels of organic material being deposited. In addition, the search for a high solar reflection (Rs) value makes it impossible to add fireproofing agents in the formulation of the deposit. It is therefore not possible to obtain a solar protection article presenting a fireproofing level of M0 or A2s1d0 type on the metal-coated face of said article. Nevertheless, level M1 can be achieved by using halogen compounds.
- Spraying a dispersion of fine metal particles such as particles of aluminum, in a binder that is generally of polymer type. As in the above technique, the use of an organic binder as the medium for dispersing the metal particles means that it is not possible to obtain a fireproofing level of M0 or A2s1d0 type on the metal-coated face of the textile layer. The M1 level is accessible only for products with a high halogen content and that have been fireproofed (e.g. PVCs with fireproofing based on antimony trioxide and zinc hydroxystannate).
- Depositing a transfer film on the surface of the textile layer, the film comprising a layer of aluminum and a polymer binder. As in the above two techniques, the presence of an organic binder makes it impossible to obtain an M0 or an A2s1d0 classification, and the M1 classification can be achieved only with halogen compounds.

Depositing a layer of aluminum on the surface of the textile layer by a vacuum metal coating operation. Unlike the above-described technologies, this mode of deposition makes it possible to cover the textile layer in a layer of pure aluminum. The difficult point with this technology is attaching the metal layer to the surface of the textile. At present, the solutions used for solving this lack of adhesion lead to putting an organic coating in place at the interface serving to provide bonding between the textile core and the metal layer. The organic layer on the metal-coated face of the cloth makes it impossible to obtain a classification of the M0, M1, or A2s1d0 type.

Furthermore, when it is desired to impart flexibility to a textile article, it is known to incorporate in the textile layer, or to deposit on at least one of its faces, a polymer mixed with at least one plasticizer, such as polyvinylchloride mixed with at least one plasticizer.

Under such circumstances, the metal layer coats the face of the textile layer that has the plasticized PVC. Nevertheless, in all the above-described techniques for depositing a metal layer, it is found that the plasticizer(s) present in the textile layer migrate(s) to the interface of the textile layer with the metal layer, thereby progressively destroying the adhesion between the textile layer and the metal layer.

At present, there is thus no technical solution that makes it possible to obtain an article for solar protection comprising a textile layer in which at least the outside face has at least one polymer mixed with at least one plasticizer and that presents simultaneously an index Rs greater than or equal to 75%, which requires the presence of a metal at the surface, together with a fire classification of the M1 type in accordance with the standard NFP 92.507, or of the B1 type in accordance with the standard DIN 4102.

Document WO 2015/071615 A1 provides a metal-coated textile free from halogen and plasticizer, in which adhesion between the textile layer and the metal layer is obtained by means of a coupling polymer forming chemical bonds between the metal layer and the textile layer, in particular directly with bridging sites supported by the inorganic fibers of the textile layer. The technique used in that document implies a textile layer using inorganic fibers that present sites that react with the coupling polymer.

JP 56274067 describes forming a metal layer by depositing vapor of a metal on a polymer body that may for example be a textile article or a film. Between the metal layer and the polymer body there is arranged a continuous intermediate adhesive layer of a condensation product obtained by causing a functional organosilane, such as the methacryloxypropyltrimethoxysilane, to react with a reactive silicone oil. The polymer body does not have a plasticized polymer. Furthermore, the adhesive layer does not have a coupling polymer bonded by chemical bonds firstly to the polymer body and secondly to the metal layer, since the organosilane reacts only with the reactive oil to form the adhesive layer.

JP 2002-254577 A1 provides an article comprising in this order: a fiber reinforcing material; a resin layer, e.g. a vinyl chloride resin including a polymer plasticizer; an adhesive layer, said adhesive layer being obtained by applying on said resin layer a solution of isopropanol and of ethyl acetate including 10% by weight of an acrylic silicone resin and 20% by weight of a polysiloxane (silicone); and finally a photocatalytic polymer layer including particles of titanium dioxide encapsulated therein. The photocatalytic polymer layer is obtained by applying a preparation in nitric acid including 5% by weight of titanium dioxide and 5% by weight of silicon dioxide. That article therefore does not include a metal layer, but rather an organic layer including for half its weight particles of titanium dioxide. In addition, the adhesive layer comprises an adhesive preparation that causes the acrylic silicone resin and a silicone to react together without forming a chemical bond with the resin layer based on vinyl chloride, or with the titanium dioxide particles dispersed in the photocatalytic layer. The adhesive layer forms a leakproof continuous film acting as a physical barrier to migration of the plasticizer towards the outer photocatalytic layer, but it does not prevent the plasticizer from migrating.

SUMMARY OF THE DISCLOSURE

Embodiments of the disclosure thus seek to provide an article, in particular a solar protection article, having an Rs index (calculated in accordance with the April 2011 standard EN 410) that is greater than 75%, and presenting an openness factor (OF) (calculated in accordance with the April 2011 standard EN 410) of about 1% to 10%, preferably about 1% to 6%, in particular about 3% to 6%, while satisfying a fire classification of M1 type in accordance with the standard NFP 92.507 or of B1 type in accordance with the standard DIN 4102.

Embodiments of the present disclosure also seek to provide an article, in particular for solar protection, in which the adhesion between the metal layer and the polymer mixed with at least one plasticizer of the textile layer is considerably improved compared with similar solar protection articles.

Embodiments of the present disclosure also seek to provide a method of depositing at least one metal layer on at least the outside face of a textile layer of an article (in particular for providing solar protection) comprising a polymer mixed with at least one plasticizer, which method is improved in terms of productivity and reproducibility, making it possible to obtain excellent adhesion between the polymer mixed with at least one plasticizer and the metal layer.

In a first aspect, an article is provided, in particular for solar protection, comprising at least one metal-coating layer and a textile layer having an outside face comprising at least one polymer mixed with at least one plasticizer to form a first matrix. Advantageously, the bonding between said first matrix and the metal-coating layer is provided by an intermediate polymer layer comprising at least one coupling polymer, said coupling polymer being bonded by chemical bonds firstly to the first matrix and secondly to the metal-coating layer.

In the context of the disclosure, chemical bonds are established between the various components of the plastic- and metal-coated textile article. These bonds are created by the polymer constituting the intermediate polymer layer. Furthermore, the intermediate polymer layer provides separation between the metal-coating layer and the outside face that comprises the polymer mixed with at least one plasticizer, such that they are not continually in contact with each other.

Advantageously, the article of the disclosure presents a metal-coating layer with peeling strength after several months of storage that is similar to its peeling strength as obtained immediately after fabrication. The durability of the peeling strength is thus very clearly improved compared with the peeling strength of prior art plastic- and metal-coated textile articles. A non-exhaustive explanation might be that the formation of permanent chemical bonds between the intermediate polymer layer and the first matrix eliminates the effect on peeling strength of the plasticizer migrating.

Although the metal coating may be applied to both faces of the textile layer (opposite outside and inside faces), embodiments of the disclosure are particularly appropriate for textile layers that are metal-coated on only one of their faces.

Preferably, said intermediate polymer layer has inside and outside faces, its inside face is in contact with the outside face of the textile layer, and its outside face is in contact with the inside face of the metal coating.

Preferably, the outside face of the metal layer faces towards the surroundings, and is optionally covered completely or in part with a varnish as described below.

The use of a textile layer in which at least the outside face comprises at least one polymer mixed with at least one plasticizer provides the article of the disclosure with its flexibility, makes it easier to handle, improves the strength of the article, and in particular enables it to be used in outdoor applications.

In a known manner, depending on the nature of the polymer and of the plasticizer, but also on its weight relative to the total weight of the mixture of the plasticized polymer, it is possible to adjust the flexibility of the plastic-coated textile layer and thus the flexibility of the textile article. The low glass transition temperature of the plastic coating polymer enables the article to be handled whatever ambient temperature might be, thereby making it more versatile.

Preferably, the weight of the first matrix relative to the total weight of the protection article is greater than or equal to 50%, more preferably greater than or equal to 60%, more preferably less than or equal to 90%, in particular less than or equal to 80%.

Finally, said at least one polymer mixed with at least one plasticizer may be mixed with numerous additives thus enabling it in particular to impart properties of withstanding fire, of withstanding bad weather, and of withstanding microorganisms.

The first matrix may comprise one or more polymers mixed with one or more plasticizers. Said polymer(s) may be thermoplastic. Preferably, the first matrix comprises polyvinyl chloride mixed with at least one plasticizer.

The first matrix may be in the form of a sheath arranged around fibers and/or yarns of the textile layer and/or in the form of a film arranged on the outside face, and possibly another film arranged on the inside face, of the textile layer.

Preferably, said at least one polymer mixed with at least one plasticizer in the first matrix is selected from synthetic thermoplastic polymers, in particular from: polyolefins such as polypropylene or indeed polyethylene; chlorinated polymers such as vinyl polymers, in particular polyvinyl chloride; acrylate polymers such as polymethacrylate or polybutyl methacrylate, or indeed polymers derived from acrylic acid; polyesters such as polyethylene terephthalate; or mixtures thereof; and more preferably from chlorinated polymers, in particular polyvinyl chloride.

Preferably, said at least one plasticizer is selected from phthalates, esters of terephthalate acid (e.g. dioctyl terephthalate (DOTP)), adipates (e.g. diethylhexyladipate (DEHA)), trimellitates (e.g. trioctyl trimellitate (TOTM)), sebacates, benzoates, citrates (e.g. tributylacetylcitrate (ATBC), cyclohexaonates (e.g. benzyl butyl cyclohexaonate 1,2 dicarboxylates), phosphates, epoxies, polyesters, alkylsulfonate esters (e.g. a mixture of sulfonic acids, phenyl esters, and C10-C18 alkanes), and DINCH (1,2-cyclohexane dicarboxylic acid, diisononyl ester).

When said at least one plasticizer is a phthalate, it is a dialkyl phthalate, in which each of the alkyl chains comprises 1 to 12 carbon atoms, said alkyl chains being linear or branched (e.g. DEHP, DINP, DIDP, DNOP, DBP, . . . ).

Preferably, said plasticizer is a phthalate. It is preferably DOTP or a mixture of plasticizers comprising DOTP and at least one cyclohexanoate, such as a benzoate.

In the state of the art, the choice of plasticizers appropriate for the first matrix is often directed towards plasticizers of high molecular weight so as to limit their migration to the interface with the metal-coating layer, where the migration phenomenon favors separation of the metal-coating layer.

Advantageously, the disclosure makes a greater number of plasticizers suitable for use, independently of their molecular weight. Specifically, the inventors have observed that not only is the immediate adhesion created between the first matrix and the metal-coating layer excellent, but that this adhesion is long-lasting, and thus independent of the migration of the plasticizer(s).

This provision thus provides greater latitude in the properties that can be given to the textile layer as a result of the first matrix (flexibility, abrasion resistance, hardness, . . . ).

Preferably, the weight of the first matrix relative to the total weight of the article is greater than or equal to 50% and less than or equal to 85%, preferably less than or equal to 75%; and the weight of the textile layer without the first matrix relative to the total weight of the article is greater than or equal to 25% and less than or equal to 50%.

Preferably, the weight of the metal constituting the metal-coating layer relative to the total weight of the article is less than or equal to 0.5%.

Preferably, said at least one polymer mixed with at least one plasticizer is selected from chlorinated polymers, in particular polyvinyl chloride.

In the context of the present disclosure, the term "metal-coating layer" is used to mean a layer in which the weight of metal is greater than or equal to 95%, preferably greater than or equal to 99%, relative to the total weight of said metal layer.

In the context of the present disclosure, the solar protection article may be an indoor or outdoor sunshade or blind, a curtain, an awning for a boat, an indoor or outdoor architectural element such as a suspended ceiling, or indeed a panel of a tent or of an article that is tensioned to form a shelter.

In the present specification, the term "plastic-coated (textile) article/layer" is used to mean that the article or the layer comprises at least one polymer mixed with at least one plasticizer.

In the present specification, the term "coupling polymer" is used to designate polymers and oligomers, in particular those in which the repeat unit number (n) is greater than or equal to 4.

In a variant, the textile layer comprises, at least on its outside face, fibers and/or yarns in which all or some of said fibers and/or yarns are each coated in a sheath formed by said first matrix.

In a variant, the chemical bonds existing firstly between the coupling polymer and the first matrix and secondly between the coupling polymer and the metal-coating layer are bonds that are covalent, hydrogen, or polar.

In a variant, the chemical bonds existing between the coupling polymer and the metal-coating layer, and optionally between the coupling polymer and the first matrix, are provided by means of M-OH functions carried by the intermediate layer or by O-M-O covalent bridges, where M=Al, Zr, Ti, Cr, or preferably Si.

In a variant, the intermediate polymer layer comprises one or more reactive function polymers selected in particular from the following at least divalent groups: hydroxy, carboxylic acid, amine, amide, anhydride, acid, isocyanate, epoxy, caprolactam, carbodimide.

Nevertheless, in the context of the disclosure, any type of polymer carrying reaction functions could be used. Mention may be made of all polycondensates (polyester, polyamide, polyurethane), and also of all self-cross-linking polymers and thermoplastic vulcanization (TPVs) (polyolefins obtained by metallocene catalysis possessing a partially vulcanized phase). An example TPV is the Sarlink® range from Teknor Apex. Such a polymer having reactive functions is functionalized with at least one coupling agent, in particular of the type comprising silane, titanate, zirconate, aluminate, or an organochromium complex, or indeed a blocked isocyanate, as explained below in order to correspond to the coupling polymer.

In a variant, the intermediate polymer layer is a polymer selected from: polyesters (in particular polyethylene terephthalate); polyamides (in particular polyamides 6, 6-4, 6-6, 6-9, 6-10, 11, 12); polyurethanes; acrylic acid ester polymers (homopolymers and copolymers of acrylic acid esters, e.g. a polymer of acrylic acid, a copolymer of acrylic acid and of methacrylic acid), optionally functionalized with carboxylic groups (—C(=O)—OH) and/or hydroxyl groups (—OH) and/or epoxy groups (including at least one oxirane group, in particular a glycidoxy group); polyolefins (in particular polypropylene and polyethylene) and copolyolefins; polyolefin elastomers such as an elastomer based on propylene, e.g. the elastomer sold under the trademark Vistamaxx by Exxon; phenoxy resins; chlorinated polymers (in particular polyvinyl chloride and polyvinylidene chloride); epoxy resins; and mixtures thereof; preferably polyurethanes and phenoxy resins.

The above-mentioned polymers may have one or more reactive functions.

In a variant, the intermediate polymer layer comes from the reaction between one or more coupling agents, possibly with one or more polymers having reactive functions, and both the metal-coating layer and also the first matrix.

In a variant embodiment, the chemical bonds existing between the coupling polymer and the first matrix, and optionally the metal-coating layer, are provided by means of functions selected from a list I of functions comprising ether functions (—O—), ester functions (—C(=O)—O), urethane functions (—NH—C(=O)—O—), urea functions (—NH—C(=O)—NH—), and/or selected from a list II of functions comprising M-OH functions carried by the intermediate layer or O-M-O covalent bridges, with M=Al, Zr, Ti, Cr, or preferably Si.

In a variant, the textile layer is made of a textile selected from the list constituted by: a non-woven fabric, a knit, a woven fabric, a grid, or a combination thereof.

The term "grid" is used to mean an array of crossed-yarns that are not interlaced, usually being adhesively bonded together at their cross-points.

In a variant, the textile layer comprises fibers and/or yarns selected from the following materials: glass, ceramics, optical fibers, yarns based on metal alloys, such as for example Fe/Ni 36 alloys, or nanocrystal type materials, basalt, carbon, polyesters (in particular polyethylene terephthalate), polyamides (in particular polyamides 6, 6-4, 6-6, 6-9, 6-10, 11, 12), aramids, polyvinyl alcohol (PVA), or mixtures thereof.

In an embodiment, the textile layer is a textile layer of inorganic fibers and/or yarns, in particular of glass fibers and/or yarns.

In another embodiment, the textile layer is a textile layer of fibers and/or yarns made of synthetic polymers, in particular of polyesters (polyethylene terephthalate).

When inorganic fibers are used, they may be covered in conventional manner in sizing that represents less than 0.5% of the weight of the fibers.

In a variant, the metal constituting the metal-coating layer is aluminum.

In another variant, the disclosure may be applied to metal-coating layers that are different, in particular, instead of a layer of aluminum, the metal-coating layer may comprise a layer of some other metal that can be deposited under reduced pressure, such as chromium, gold, silver, tin, or nickel, or indeed a layer of a metal having shielding properties against electromagnetic waves, such as a layer of Invar (Fe/Ni 36% alloy), or of mumetal (or "p-metal") (NiFe15Mo5 or NiFe15Cu5Mo3, in particular).

In a variant, the coupling polymer represents 0.1% to 25%, preferably 0.5% to 25%, more preferably 0.5% to 7%, still more preferably 2% to 7%, specifically 2% to 6% by weight of the total weight of said article.

In a variant, the metal-coating layer is covered in a varnish in order to avoid it oxidizing and/or corroding.

In a subvariant, said varnish represents less than 1% by weight of the weight of said article.

In a second aspect, the present disclosure provides a method of depositing a metal-coating layer on at least the outside face of a textile layer, said outside face comprising at least a polymer mixed with at least one plasticizer forming a first matrix, in order to obtain an article in accordance with any of the variants described above with reference to a first aspect.

Advantageously, said method comprises the following successive steps:

a) preparing a solution or a dispersion including a coupling polymer or a mixture of coupling polymers, said polymer(s) carrying coupling functions capable of making chemical bonds between the coupling polymer and the first matrix, and coupling functions capable of making chemical bonds between the coupling polymer and the metal of the metal-coating layer, which functions may be identical or different;

b) sizing at least the outside face of the textile layer that comprises the first matrix with the solution or dispersion prepared in step a);

c) applying heat treatment serving in particular to fix the coupling polymer chemically to the surface of the first matrix of the textile layer so as to fix a layer of intermediate polymer on the first matrix of the textile layer; and d) metal coating, by depositing metal vapor under reduced pressure on at least a portion of the outside face of the previously treated textile layer, leading to the formation of chemical bonds between the intermediate polymer layer and the metal-coating layer that is formed.

Advantageously, the method of the disclosure makes it possible to form an intermediate polymer layer that develops chemical bonds both between the intermediate polymer layer and the metal-coating layer, and also between the intermediate polymer layer and the first matrix, thereby providing excellent ability to withstand delamination between the first matrix and the metal-coating layer, and to do so lastingly, in spite of the plasticizer(s) in the first matrix migrating to its surface.

The various embodiment variants defined with reference to a first aspect apply likewise to the disclosure in a second aspect.

In a variant, the opposite inside and outside faces of the textile layer are both sized in step b).

In a variant, the inside and outside faces of the sized textile layer obtained at the end of step c) are both metal coated in step d) (possibly also being subjected to a step i) as defined below).

Preferably, the metal-coating step d) includes a step i) prior to depositing the metal-coating layer, in which the first matrix coated in the intermediate polymer layer is subjected to plasma treatment that consists in inserting the textile layer having at least its outside face comprising a polymer mixed with at least one plasticizer and coated in the intermediate polymer layer obtained at the end of step c) into an enclosure into which a plasma gas is inserted, preferably an oxygen plasma. The enclosure is preferably evacuated, and more preferably the air in the enclosure is pumped out and exhausted so as to reach a pressure that is less than or equal to $10^{-5}$ Torr.

This preliminary activation step i) has several functions: it serves to graft the coupling polymer chemically to the first matrix so as to fasten an intermediate polymer layer on the outside face of the textile layer comprising said first matrix; eliminating the dispersion medium or the solvent used for preparing the polymer deposit, and correspondingly physically cleaning said outside face of the textile layer comprising said first matrix; and "deblocking" the coupling functions so as to lead to the desired chemical bonds that provide "chemical" adhesion of the metal-coating layer on the coupling polymer. Under such circumstances, it is possible in particular to observe activation of the surface of the intermediate polymer layer giving rise to the formation of hydrophilic functional groups, in particular oxygenated groups, such as hydroxyl, carbonyl, carboxyl groups, (hyper) peroxides, and carbonates, . . . . Functionalizing the intermediate polymer layer with hydrophilic groups serves to increase the wettability of the intermediate polymer layer and thus its suitability for adhesion.

This preliminary activation step i) could equally well be performed by corona treatment, even though plasma treatment is preferred.

These "deblocked" coupling functions, in particular of OH type, come from the coupling agent selected in particular from: silanes, titanates, zirconates, aluminates, blocked isocyanates, and organochromium complexes that, after bonding to the polymer, or after polymerizing with itself, serves to form the coupling polymer.

Preferably, the coupling agent is a silane or a blocked isocyanate.

The term "blocked isocyanate" is used to mean any compound having the NH—C(═O)—B function, in particular any compound of formula A-NC—C(=O)—B, which under the effect of a determined deblocking temperature Td (° C.) generates a compound having the isocyanate function —N=C=O, or an isocynate written A-N=C=O, and the blocking agent B-H which should have a labile hydrogen atom.

B represents the blocking agent that has lost its labile hydrogen atom.

A may be or may include in its structure: a hydrogen atom; a C1-C20 alkyl group; one or more C3-C10 cycloalkyl groups, which may be saturated or unsaturated, e.g. one or more aromatic cycles, e.g. one or more benzene groups; a vinyl group ($CH_2$=CH—); a C1-C20 alkyl group substituted by a vinyl group ($CH_2$=CH—); a C1-C20 alkyl group substituted by a primary amine and/or a secondary amine and/or a tertiary amine; a primary amine; a secondary amine; a tertiary amine; a C1-C20 alkyl group substituted by a thiol group; a thiol group; a urea group; a C1-C20 alkyl group substituted by a urea group; an isocyanate group; a C1-C20 alkyl group substituted by an isocynate group.

Said above-mentioned alkyl groups are saturated, linear or branched, in the range C1-C20, more preferably C1-C15, even more preferably C1-C10, and the cycloalkyl groups are preferably in the range C3-C6.

In the context of the present disclosure, when a group is a Cn-Cp group, that means that it presents n to p carbon atoms, where n and p are integers.

The blocking agent may be selected from phenols (Td≥180° C.); alcohols (Td≥180° C.); oximes (Td≥130° C.); lactams (Td≥150° C.); triazoles (Td≥180° C.); imidazoles (Td≥160° C.); β-dicarboxylate compounds (Td≥130° C.); hydrosuccinimide; bisulfites; and is preferably selected from lactams (carbon cycle including an amide function), e.g. caprolactam.

Preferably, the deblocking temperature Td (° C.) is greater than or equal to 150° C.

This preliminary activation step i), in particular by plasma treatment, may serve initially as a result of the heat that is given off to release the active function of the coupling polymer and thus establish the bond between the polymer layer and the first matrix, with this advantageously taking place in an anhydrous medium, thus making it possible to use reactive functions of blocked isocyanate types. It also leads to deblocking the coupling functions that might be present in the polymer in order to enable it to be coupled subsequently with the metal.

Depending on the nature of the polymer, the preparation used for performing sizing, referred to as the deposition preparation, may be made in an aqueous dispersion or an aqueous solution or as a dispersion in an organic solvent such as an alcohol, a ketone, Preferably, the deposition preparation is an aqueous dispersion enabling a discontinuous intermediate polymer layer to be formed, thereby leaving zones in which the first matrix and the metal-coating layer are in contact.

This provision makes it possible to provide degrees of freedom between the intermediate polymer layer and both the first matrix and also the metal-coating layer.

The article is therefore not stiffened and conserves flexibility similar to that of the textile layer having the first matrix.

The components of the polymer deposition preparation are as follows:

optionally a polymer binder possessing reactive functions:

a coupling agent for providing bonding between the first matrix and the polymer; and a coupling agent for providing bonding between the polymer and the metal.

It is possible to use a coupling agent to provide the bonding between the first matrix and the polymer that is identical to or different from the coupling agent used for providing the bonding between the polymer and the metal.

The coupling agents may be silanes, titanates, zirconates, aluminates, or organochromium complexes, or indeed blocked isocyanates, and preferably they are silanes or blocked isocyanates As examples of titanates or zirconates, mention may be made of compounds of formula $(XO)_nZ(OY)_{4-n}$, where X is an alkyl group, e.g. n-propyl, iso-propyl, n-butyl, iso-octyl ethyl, Y is an organo functional group, e.g. of the carboxyl, ester, phosphonato, pyro-phosphonato, sulfonato type, and Z is Ti for a titanate or Zr for a zirconate, with m lying in the range 1 to 3. Complete ranges dedicated to each type of polymer are available from the suppliers Famas Technology, Capatue Chemical, In preferred manner, the coupling agents are organosilanes carrying one to three OH or alcoxy. functions, and at least one organic portion R possessing a function enabling covalent grafting on the polymer. They are usually organosilanes carrying one to three OH or alcoxy functions (where alcoxy functions hydrolyze in an aqueous medium to form OH functions), of formula that may be written generically as $(R'O)_m$—$Si(R)_{4-m}$, where m lies in the range 1 to 3, and R' may be H or an alkyl group, in particular a group having 1 to 4 carbon atoms. It is possible for a single silicon atom to carry different OR' and/or R groups.

At least one of the organic portions R possesses a function enabling grafting on the polymer (at least one polymer present in the first matrix, and possibly the polymer designated in the present specification as the polymer with reactive functions). The way this function is selected thus depends on the nature of the polymer and of the reactive functions it carries. For example, if the polymer is a polyurethane, the organic portion R should contain an amine or an epoxy function. Complete ranges of organosilanes dedicated to each type of polymer are available from the suppliers Dow Corning, Wacker, Mometive, and Shin-Etsu.

If the first matrix includes zinc carboxylate, the coupling agent may for example be an aminophenylsilane, the portion R then including an aminobenzene function. Under such circumstances, there is no need to use a polymer having reactive functions.

In an embodiment, said at least one polymer having reactive functions is a polyurethane or a phenoxy resin, and said at least one coupling agent is a blocked isocyanate.

During the operation of preparing the bath, the coupling agents react on certain reactive functions of the polymer, or they polymerize themselves, so as to form a modified polymer enabling chemical coupling with the first matrix of the textile layer and with the metal-coating layer. This "coupling" polymer is advantageously used at a very low content, in particular so that it represents about 0.5% to 7% by weight, in particular 2% to 7% by weight, specifically 2% to 6% by weight of the final article of the disclosure.

The presence of a fireproofing agent serves to mitigate the degradation of non-fire properties associated with the presence of organic compounds. Specifically, the intermediate polymer layer, and thus the deposition preparation, may include one or more fireproofing agents, even though that is not preferred in the context of the present disclosure.

In a variant, the method of the disclosure includes a step of chemically cleaning the outside face of the textile layer comprising the first matrix, said step consisting in applying a solution or a dispersion containing a surfactant or a mixture of surfactants on the first matrix, this cleaning step taking place before step b) with a non-sized first matrix, or together with step b) with the surfactant(s) then being added to the solution or the dispersion of step a).

The surfactants may be anionic surfactants (sulfonate ions, sulfate ions, carboxylate ions), cationic surfactants (protonated amines, esterquats), non-ionic surfactants, amphoteric zwitterionic surfactants, and they are preferably non-ionic surfactants.

Preferably, the surfactants for performing chemical cleaning do not contain silicone (i.e. their structure does not contain the —Si—O—Si— function in repeated manner).

By way of example, the mixture of surfactants may comprise a mixture of ester, of phosphoric acid, and of fatty alcohol, such as Sulveol NSE sold by Thor or indeed Dynol 607 sold by the supplier Air Product.

Said surfactant(s) may be selected from aminomethyl propanols, such as that sold by Dow under the trademark AMP 90.

Preferably, said dispersion or solution has a weight content of surfactant(s) (measured relative to the total weight of said dispersion or solution) that is greater than 0% and less than or equal to 2%, preferably less than or equal to 1%, still more preferably less than or equal to 0.5%.

Said chemical cleaning step serves to eliminate any external pollution and to remove any additives and fats present at the surface of the first matrix.

In a variant, the solution or dispersion prepared in step a) is made with 1% to 95% coupling agent(s), 0% to 95% polymers having reactive functions, and 0.05% to 10% formulation agents, these percentages being given on the dry extract relative to the total weight of the dry extract corresponding to the prepared solution or dispersion.

In an embodiment, the proportion by weight of coupling agent(s) in the solution or dispersion in step a) relative to the total dry extract weight of the solution or dispersion is greater than or equal to 70%, preferably greater than or equal to 90%, more preferably greater than or equal to 95%. This provision applies in particular when the coupling polymer is obtained by using coupling agent(s) without any polymer(s) having reactive functions.

In another embodiment, the proportion by weight of coupling agent(s) in the solution or dispersion in step a) relative to the total dry extract weight of the solution or dispersion is greater than or equal to 0.1%, in particular greater than or equal to 0.5%, and less than or equal to 30%, in particular less than or equal to 20%.

Under such circumstances, and preferably, the proportion by weight of polymer(s) having reactive functions in the solution or dispersion in step a) relative to the total dry extract weight of the solution or dispersion is greater than or equal to 60%, more preferably greater than or 70%, still more preferably greater than or equal to 80%.

Preferably, the dry extract by weight of the solution or dispersion in step a) lies in the range 15% to 50%.

Preferably, the weight content of water and/or solvent(s) in the solution or dispersion in step a) lies in the range 50% to 85%.

Preferably, the deposition preparation prepared in step a) is made with 1% to 30%, preferably with 1% to 25%, more preferably 1% to 20%, still more preferably 1% to 6%, and in particular 1% to 5% coupling agent(s); with 50% to 95%, preferably 60% to 95% polymer(s) with reactive functions; and with 0.05% to 1% formulation agent(s), these percentages being given in terms of dry extract relative to the total weight of the dry extract corresponding to the deposition preparation.

Any type of formulation agent conventionally used in depositing polymers may be introduced, e.g. of the anti-foaming agent type, the wetting agent type, . . . .

Advantageously, the deposition preparation contains an anti-foaming agent. It is possible to use any conventional anti-foaming agent well known to the person skilled in the art and advantageously to use agents from the polysilane family, and in particular BYK™-094 sold by BYK Chemie, or from the polyether siloxane copolymer family and in particular Tego™ Foamex 825, sold by the supplier Degussa.

The deposition preparation for the polymer is then applied on a textile layer that has already been made.

The polymer deposition preparation may be applied by any conventional technique for treating textile material, conventionally referred to as "sizing": full bath impregnation followed by squeezing in a padding mangle, back-filling, spraying, lick roller, rotary frame coating (e.g. Zimmer or Stork head), . . . .

Techniques for depositing the polymer layer on only one of the faces of the textile are preferred. It is possible to use a deposition method followed by padding. Padding serves to eliminate excess polymer on rollers (known as a padding mangle in the language of the person skilled in the art).

The operation of metal coating the surface of the polymer-covered textile is then performed using any known technique, preferably depositing metal under reduced pressure from metal vapor, conventionally referred to as vacuum metal deposition. The metal coating is usually deposited on only one of the faces of the textile layer, namely its outside face having the first matrix. Thus, under such circumstances, when the coupling polymer has been deposited on the outside and inside faces of the textile layer (as happens in particular by impregnating the textile layer in a bath), the inside face of the textile layer is covered in coupling polymer and the outside face having the first matrix is covered in coupling polymer that is itself covered in a layer of metal. Conventionally, a pressure lying in the range $10^{-2}$ Torr to $10^{-4}$ Torr and a temperature lying in the range 30° C. to 100° C. are applied during metal coating. The pressure and the temperature should be adapted by the person skilled in the art depending on the metal used.

During this metal coating, the coupling functions remaining on the polymer layer form chemical bonds with the metal. There is thus good cohesion between the first matrix and the metal-coating layer as provided by the intermediate polymer layer. A metal-coating layer is thus obtained having thickness that generally lies in the range 3 nanometers (nm) to 100 nm.

Finally, the article obtained according to the disclosure is preferably made up of:

- 0.5 to 7 parts (preferably 2 to 7 parts, more preferably 2 to 6 parts) by weight of coupling polymer;
- ≤0.5 parts by weight of metal constituting the metal-coating layer; in particular the metal should be present in the range 0.01 to 0.5 parts by weight;
- 50 to 75 parts by weight of the first matrix constituting the textile layer, per 100 parts; and
- 25 to 50 parts by weight of fibers/yarns without the first matrix constituting the textile layer, per 100 parts.

In a variant, the coupling agent(s) is/are selected from silanes, titanates, zirconates, aluminates, blocked isocyanates, and organochromium complexes, preferably silanes and blocked isocyanates, more preferably silanes.

In a variant, the coupling agent(s) is/are selected from organosilanes carrying one to three OH or alcoxy functions, and at least one organic portion R possessing a function enabling them to be covalently grafted on the polymer with reactive functions and/or on the first matrix and/or on the metal-coating layer.

The organic portion R preferably comprises an amine function or an epoxy function.

In a variant, step d) is followed by a step of depositing a varnish on the surface of the metal-coating layer in order to avoid it oxidizing and/or corroding.

By way of example, the varnish may be a polyurethane varnish, such as that sold under the trademark Impranil DLN PUR.

Furthermore, the plastic- and metal-coated textile layer obtained in the context of the disclosure may be treated by depositing a varnish on the surface of the metal-coating layer, in particular to avoid it oxidizing and/or corroding. Such varnishes are in particular of the following types: polyurethane; polyacrylic; polyvinyl; silicone or epoxy; fluorocarbon or a paraffin dispersion. When such a varnish is applied on the metal-coating layer it generally represents less than 1% of the total weight of the final textile, and in general 0.2% to 0.6%. Such operations may be performed using conventional techniques that are well known to the person skilled in the art, in particular a person fabricating textiles for solar protection.

In a variant, the textile layer has fibers and/or yarns in which at least a portion of said fibers and/or yarns are individually coated in full or in part by a sheath made up of the first matrix.

In a subvariant, the fibers and/or yarns are individually coated in the first matrix that forms a sheath by being immersed in a bath comprising a dispersion of at least one polymer in at least one liquid plasticizer.

Preferably, said liquid dispersion forms part of the plastisol family.

In another subvariant, the yarns are individually coated in the first matrix forming a sheath by extrusion-sheathing said yarns with an extrudable composition including at least one polymer and at least one plasticizer.

In a variant, the first matrix includes one or more colored pigments.

DETAILED DESCRIPTION OF EMBODIMENTS

The following examples serve to illustrate the embodiments of the disclosure and they are given in a non-limiting manner.

EXAMPLE 1

The method described below was applied to a textile layer weighing about 390 grams per square meter (g/m$^2$), comprising yarns sheathed in a first matrix comprising polyvinyl chloride (PVC) together with at least one plasticizer, such as diisodecyl phthalate (DIDP). The textile layer comprised glass yarns representing about one-third by weight of its total weight and said first matrix represented about two-thirds by weight of its total weight. Thus, in this example, the first matrix was to be found on both of the opposite inside and outside faces of the textile layer. The plastic-coated textile layer was subjected to a prior chemical cleaning step by being immersed in a cleaning solution as described in Table 1 below. The plastic-coated textile layer as cleaned in this way is then dried by passing over a tenter frame, with the drying time being 120 seconds (s) at 150° C.

TABLE 1

| Type of raw material | Chemical nature Commercial reference | Percentage by weight |
|---|---|---|
| Dispersion medium | water | 99.5 |
| Surfactant | Sulveol NSE | 0.5 |
| Total | | 100.0 |

The preparation for deposition was prepared by adding in succession into the necessary quantity of water while being stirred: Permutex Evo Ex RU 92-605 (having a dry extract of about 40%), Permutex XR 92-203, was then BYK 094 drop by drop with the proportions set out in Table 2 below. The deposition preparation was maintained under stirring at 100 revolutions per minute (rpm) to 300 rpm using a four-blade mixer having a deflocculating type blade and at ambient temperature (20° C.-25° C.) for at least 30 minutes (min).

TABLE 2

| Type of raw material | Chemical nature Commercial reference | Percentage by weight |
|---|---|---|
| Dispersion medium | water | 34.0 |
| Polymer with reactive functions | Stahl Permutex Evo Ex RU 92-605 polyurethane | 60.0 |
| Coupling agent | Stahl Permutex XR 92-203 blocked isocyanate | 6.0 |
| Anti-foaming agent | BYK Chemie Byk 094 polydimethylsiloxane | 0.05 |
| Total | | 100.05 |

The plastic-coated and cleaned textile layer was then passed through a bath of the above-described deposition preparation (step a)), and then squeezed between to rollers in order to remove the excess deposition preparation by padding, the pressure in the padding mangle lying in the range 0.7 bar to 1.5 bar. The plastic-coated textile layer impregnated with the deposition preparation was dried on a tenter frame at 150° C. for about 120 s (step c)).

The plastic-coated textile layer itself coated in the deposition preparation was then subjected to a preliminary step i) of activating the first matrix coated in the intermediate polymer layer, which consisted in introducing the plastic-coated textile layer with the intermediate polymer layer obtained at the end of step c) into an enclosure, in particular a vacuum enclosure (pressure of about $10^{-5}$ Torr) into which an oxygen plasma was injected, the temperature of the plasma gas being about 900° C.-1000° C. The treatment time was shorter than 1 s.

Prior to the plasma treatment i), the plastic-coated textile layer having the intermediate polymer layer at the end of step c) was dried in a gas oven (speed 10 meters per minute (m/min)) at a temperature of about 130° C.

The plastic-coated textile layer after plasma treatment was then subjected to a metal coating step (step d)) by depositing aluminum vapor under low pressure on its outside face at a pressure in the range $10^{-4}$ millibars (mbar) to $10^{-5}$ mbar, the metal coating speed lying in the range 9 meters per second (m/s) to 14 m/s.

By way of example, the above-defined steps i), c), and d) can be performed using a Leybold TopMet machine, e.g. as sold by the supplier Leybold Systems.

The solar protection article that was obtained presented a weight per unit area lying in the range 395 g/m$^2$ to 400 g/m$^2$.

The OF value of the textile layer is 5% was measured in compliance with the April 2011 EN 410 standard. The Rs value of the resulting article for solar protection as measured in compliance with the April 2011 EN 410 standard was 84%.

The resulting solar protection article presented an M1 fire resistance value measured in compliance with the (February 2004) NFP 92507 standard and an absolute DL* value in the adhesion test as described below (–DL* peeling) of 0.6±0.01 as measured immediately after metal coating, and of 0.6±0.01 as measured 11 months after metal coating.

The method of measuring peeling strength in the present specification comprises the following steps:

- cutting out a strip of SU that is about 4 centimeters (cm) to 5 cm wide and about 25 cm long;
- positioning double-sided adhesive tape having the reference 64621 as produced by the supplier TESA on the metal-coated face of the solar protection article for testing over 20 cm, while leaving 5 cm free of tape in order to obtain to position it in the jaw of the dynamometer, and also having 5 cm free of SU;
- passing through a laboratory padding mangle, pressure =1 bar;
- dynamometer testing, traction method, travel speed=100 millimeters per minute (mm/min);
- positioning the SU in the bottom jaw and the free adhesive tape portion in the top jaw;
- selecting the "traction" method and peeling the adhesive tape from the solar protection article, with the result being the maximum resistance value; and
- measuring DL* in a spectrocolorimeter on the adhesive tape, measuring L* before the test and L* after the test. The greater the value of DL* (delta), the greater the amount of the metal coating that has become deposited on the adhesive tape, and conversely the closer the value of DL* is to zero, the greater the mechanical strength of the metal-coated layer.

EXAMPLE 2

The above-described method was applied to a textile layer, weighing about 390 g/m$^2$, comprising yarns sheathed in a first matrix comprising polyvinylchloride (PVC) with at least one plasticizer, such as DIDP. The first matrix is thus to be found on both of the opposite inside and outside faces of the textile layer. In this example, the deposition preparation was formulated so as to make it possible also to clean the plastic-coated textile layer chemically.

The deposition preparation was prepared by adding the following in succession to the necessary quantity of water that was maintained under stirring: BYK 094; a phenoxy resin (InChemRez PKHW38); a silane (Coatosil C2287); and AMP 90 using the proportions set out in Table 3 below. The deposition preparation was maintained under stirring at 100 rpm to 300 rpm using a four-blade mixer having a deflocculating type blade at ambient temperature (20° C.-25° C.) for at least 30 min.

TABLE 3

| Type of raw material | Chemical nature Commercial reference | Percentage by weight |
|---|---|---|
| Dispersion medium | water | 50.0 |
| Polymer with reactive functions | InChemRez PKHZ38 phenoxy resin | 49.3 |
| Coupling agent | Coatosil C2287 silane (3-glycidoxypropylmethyl diethoxysilane) | 0.7 |
| Anti-foaming agent | BYK Chemie Byk 094 polydimethylsiloxane | 0.05 |
| Surfactant | Dow Amp 90 2-amino-2-methyl-1-propanol | 0.15 |
| Total | | 100.0 |

The plastic-coated and cleaned textile layer was then passed through a bath of the above-described deposition preparation (step a)), and was then squeezed between two rollers in order to remove excess deposition preparation by padding, the padding mangle pressure lying in the range 0.7 bar to 1.5 bar. The plastic-coated textile layer impregnated with the deposition preparation was dried on a tenter frame at 120° C. for about 1 min (step c)).

Advantageously, the deposition preparation was formulated so as also to perform chemical cleaning of the textile layer, in particular so as to degrease the textile layer, i.e. remove the plasticizer(s) migrating to the surface of the fibers and/or the yarns.

The plastic-coated textile layer coated in the deposition preparation was then subjected to a preliminary step i) of activating the first matrix coated in the intermediate polymer layer, which consisted in introducing the plastic-coated textile layer including the polymer intermediate layer obtained at the end of step c) into a closed enclosure, in particular a vacuum enclosure (pressure about $10^{-5}$ Torr) into which an oxygen plasma was injected, the temperature of the plasma gas being about 900° C.-1000° C. In this particular example, this was plasma treatment. The treatment time was shorter than 1 s.

Prior to the preliminary activation step i), the plastic-coated textile layer including the intermediate polymer layer at the end of step c) was dried in a gas oven (speed 10 m/min) at a temperature of about 130° C.

The plastic-coated textile layer after plasma treatment was then subjected to a metal coating step (step d)) by depositing aluminum vapor under low pressure on its outside face at a pressure in the range $10^{-4}$ mbar to $10^{-5}$ mbar, the metal coating speed lying in the range 9 m/s (m/s) to 14 m/s.

The resulting solar protection article had weight per unit area of about 395 g/m$^2$ to 400 g/m$^2$.

The OF value of the textile layer was 5% as measured in compliance with the April 2011 EN 410 standard. The Rs value of the resulting article for providing solar protection as measured in compliance with the April 2011 EN 410 standard was 85%.

The resulting solar protection article presented a fire resistance value M1 as measured in compliance with the (February 2004) NFP 92507 standard and an absolute DL* value in the adhesion test described below (peeling –DL*) of 0.7±0.01 immediately after metal coating, and of 0.68±0.01 as measured 11 months after metal coating.

EXAMPLE 3

This example differs from Example 2 by the preparation of the deposition dispersion in step a).

An epoxysilane was initially hydrolyzed under the conditions set out in Table 4 below in order to form a coupling agent. Acetic acid was added to Coatosil MP 200 under stirring at a speed of about 100 rpm to 300 rpm, at ambient temperature (20° C.-25° C.) using a four-blade mixer having a deflocculating type blade for 10 min. Thereafter, deionized water was added initially drop by drop and then at a faster rate to obtain the quantity set out in Table 1. The pH of the coupling agent was about 3.

TABLE 4

| Type of raw material | Chemical nature Commercial reference | Percentage by weight |
|---|---|---|
| Dispersion medium | water | 60 |
| Coupling agent | Coatosil MP 200 epoxysilane | 30 |
| 40% acetic acid | $CH_3COOH$ | 10 |
| Total | | 100.0 |

The deposition preparation was prepared by adding the following in succession to the necessary quantity of water (provided by the hydrolyzed silane) while being maintained under stirring: BYK 094; a phenoxy resin (InChemRez PKHW38); and hydrolyzed Coatosol MP 200 (cf. below) in the proportions set out in Table 5 below. The deposition preparation was maintained under stirring at 100 rpm to 300 rpm using a four-blade mixer having a deflocculating type blade, at ambient temperature (20° C.-25° C.) for at least 30 min.

TABLE 5

| Type of raw material | Chemical nature Commercial reference | Percentage by weight |
|---|---|---|
| Polymer with reactive functions | InChemRez PKHW38 phenoxy resin | 70.0 |
| Coupling agent | Hydrolyzed MP 200 as in Table 4 | 30.0 |
| Anti-foaming agent | BYK Chemie Byk 094 polydimethylsiloxane | 0.05 |
| Total | | 100.05 |

The plastic-coated and cleaned textile layer was then passed through a bath of the above-described deposition preparation (step a)), and then squeezed between two rollers in order to remove the excess deposition preparation by padding, the pressure of the padding mangle lying in the range 0.7 bar to 1.5 bar. The plastic-coated textile layer impregnated with the deposition preparation was dried on a tenter frame at 150° C. for about 2 min (step c)).

The preliminary activation step i), and the metal coating step d) was applied to the textile layer impregnated with the deposition solution and dried as defined in Example 2.

The Rs value was 83.7% measured in compliance with the April 2011 EN 410 standard.

The resulting solar protection article had a weight per unit area of about 395 g/m$^2$ to 400 g/m$^2$.

The resulting solar protection article presented a fire resistance value M1 in compliance with the (February 2004) NFP 92507 standard and an absolute value of DL* in the above-described adhesion test (peeling) of 0.65 ±0.01 immediately after metal coating, and of 0.64 ±0.01 measured 11 months after metal coating.

EXAMPLE 4

This example differs from Example 2 by the components of the deposition preparation in step a). Given that the coupling polymer in this specific example was formed from the coupling agent alone, the proportion by weight of coupling agent was much greater than the proportion by weight used as coupling agent compared with the dry extract in the examples that also made use of a polymer with reaction functions.

TABLE 6

| Type of raw material | Chemical nature Commercial reference | Percentage by weight |
|---|---|---|
| Dispersion medium | water | 70 |
| Coupling agent | Coatosil C2287 | 30 |
| Anti-foaming agent | BYK Chemie Byk 094 polydimethylsiloxane | 0.05 |
| Surfactant | Dow Amp 90 2-amino-2-methyl-1-propanol | 0.15 |
| Total | | 100.0 |

The Rs value as measured on the finished article (395 g/m$^2$-400 g/m$^2$) was 83.7% measured in compliance with the April 2011 EN 410 standard.

The resulting solar protection article presented a fire resistance value M1 as measured in compliance with the (February 2004) NFP 92507 standard and an absolute value of DL* in the above-described adhesion test (peeling) of 0.65±0.01 immediately after metal coating, likewise of 0.65±0.01 three months after metal coating, and still of 0.64±0.01 six months after metal coating.

COMPARATIVE EXAMPLE 5

A plastic-coated textile layer was subjected to all of steps defined in Example 1, with the exception of the steps serving to apply an intermediate polymer layer (steps a), b), and c)).

The resulting solar protection article presented a fire resistance value M1 measured in compliance with the (February 2004) NFP 92507 standard and a value in the adhesion test described below (peeling -DL*) of 2 immediately after metal coating. After six months, the absolute value of DL* rose to 3. Peeling strength thus decreased strongly, with this drop being due very probably to the plasticizer migrating to the interface between the first matrix and the metal-coated layer.

By way of comparison, after six months, the absolute value of DL* in Examples 1 to 3 of the disclosure lay in the range 0.4 to 0.6. Peeling strength was thus much more stable and durable independently of migration of the plasticizer.

Examples 6 and 7 below were performed using the same steps and on the same plastic-coated textile layer as defined with reference to Example 1, with only the different characteristics being set out in Table 7 below.

TABLE 7

| CAS No. or generic name | Component function | Order of insertion | Comparative example 6 (C) | Example 7 (D) |
|---|---|---|---|---|
| Water | Solvent | 1 | 50 g | 50 g |
| Polysiloxane | Anti-foaming agent | 2 | 1 g | 1 g |
| Carboxyl acrylic acid ester copolymer | Binder polymer with reactive functions | 3 | 50 g | 50 g |
| 28897-60-1 | Epoxysilane coupling agent | 4 | — | 0.7 g |
| 67674-67-3 | Surfactant | 5 | 1 g | 1 g |
| Stirrer | | | IKA small blade | Dispermat small blade |
| Stirring speed | rpm | | 600 | 600 |
| Padding pressure | bar | | 1 | 1 |
| 1st pass drying | ° C. | | 135° C. | 135° C. |
| Drying time | min | | 2 | 2 |
| pH - T0 | | | | 8.75 |
| pH - T48 h | | | | 8.90 |
| Rs (%) measured with April 2011 EN 410 standard | | | 84.8 | 8.48 |
| Absolute value of DL* in below-described adhesion test (peeling-DL*) immediately after metal coating | | | 1.39 ± 0.01 | 0.38 ± 0.01 |
| Absolute value of DL* in below-described adhesion test (peeling-DL*) two months after metal coating | | | 1.43 ± 0.01 | 0.37 ± 0.01 |

The articles of Examples 6 and 7 were coated in a varnish on the metal-coated face in order to avoid the metal-coating layer oxidizing. The dispersion forming the varnish is set out in Table 8 below.

TABLE 8

| Components | Component function | Order of insertion | % by weight relative to the total weight of the dispersion |
|---|---|---|---|
| Water | Solvent | 1 | 90 |
| Dispersion of fluorocarbon resin | Binder | 2 | 10 |
| Polysiloxane | Anti-foaming agent | 3 | 0.1 |

It can be seen that Example 7 provides very good peeling strength compared with comparative Example 6.

The peeling strength in comparative Example 6 as obtained without coupling agent deteriorates over time as a result of the plasticizer migrating.

The use of a coupling polymer that develops chemical bonds with the first matrix and with the metal-coating layer serves to greatly improve the peeling strength as measured immediately after metal coating. This peeling strength advantageously remains stable after six months, as shown above.

It should be observed that the peeling strength of comparative Example 6 is improved compared with comparative Example 5 because of the presence of an adhesive layer that is formed specifically by the binder and because of the step of chemically cleaning the plastic-coated textile layer.

Notably, although some features, concepts or aspects of the inventions may be described herein as being a preferred or advantageous arrangement or method, such description is not intended to suggest that such feature is required or necessary unless expressly so stated.

The invention claimed is:

1. An article for solar protection, comprising at least one metal-coating layer and a textile layer having an outside face comprising at least one polymer mixed with at least one plasticizer to form a first matrix, the article being wherein the bonding between said first matrix and the metal-coating layer is provided by an intermediate polymer layer comprising at least one coupling polymer, said coupling polymer being bonded by chemical bonds firstly to the first matrix and secondly to the metal-coating layer, wherein the chemical bonds existing between the coupling polymer and the metal-coating layer are provided by means of M-OH functions carried by the intermediate layer or by O-M-O covalent bridges, where M=Al, Zr, Ti, Cr or Si.

2. The article according to claim 1, wherein the weight of the first matrix relative to the total weight of the article is greater than or equal to 50% and less than or equal to 85%, and the weight of the textile layer relative to the total weight of the article is greater than or equal to 25% and less than or equal to 50%.

3. The article according to claim 1, wherein the weight of the metal constituting the metal-coating layer relative to the total weight of the article is less than or equal to 0.5%.

4. The article according to claim 1, wherein said at least one polymer mixed with at least one plasticizer is selected from chlorinated polymers.

5. The article according to claim 1, wherein the textile layer comprises, at least on its outside face, fibers and/or yarns in which all or some of said fibers and/or yarns are each coated in a sheath formed by said first matrix.

6. The article according to claim 1, wherein the chemical bonds existing between the coupling polymer and the first matrix are covalent, hydrogen, or polar bonds.

7. The article according to claim 1, wherein the chemical bonds existing between the coupling polymer and the metal-coating layer are provided by means of M-OH functions, where M=Al, Zr, Ti, Cr or Si.

8. The article according to claim 1, wherein the chemical bonds existing between the coupling polymer and the metal-coating layer are provided by O-M-O covalent bridges, where M=Al, Zr, Ti, Cr or Si.

9. The article according to claim 1, wherein the intermediate polymer layer is a polymer selected from: polyesters, polyamides, polyurethanes, polyacrylics, polyolefins, copolyolefins, polyolefin elastomers, phenoxy resins, chlorinated polymers, epoxy resins, and mixtures thereof.

10. The article according to claim 1, wherein the textile layer comprises fibers and/or yarns selected from the following material(s): glass, ceramics, optical fibers, yarns based on metal alloys, basalt, carbon, polyesters, polyamides, aramids, polyvinyl alcohol (PVA), and mixtures thereof.

11. The article according to claim 1, wherein the metal constituting the metal-coating layer is aluminum.

12. The article according to claim 1, wherein the coupling polymer represents 0.1% to 25% by weight, of the total weight of said article.

13. The article according to claim 1, wherein the coupling polymer represents 0.5% to 7% by weight, of the total weight of said article.

14. A method of depositing a metal-coating layer on the outside face(s) of a textile layer, said outside face including at least one polymer mixed with at least one plasticizer forming a first matrix, in order to obtain an article according to claim 2, wherein the method comprises the following successive steps:

a) preparing a solution or a dispersion including a coupling polymer or a mixture of coupling polymers, said polymer(s) carrying coupling functions capable of making chemical bonds between the coupling polymer and the first matrix, and coupling functions capable of making chemical bonds between the coupling polymer and the metal of the metal-coating layer, which functions may be identical or different;

b) sizing at least the outside face of the textile layer that comprises the first matrix with the solution or dispersion prepared in step a);

c) applying heat treatment serving in particular to fix the coupling polymer chemically to the surface of the first matrix of the textile layer so as to fix a layer of intermediate polymer on the textile layer first matrix; and d) metal coating, by depositing metal vapor under reduced pressure on at least a portion of the outside face of the previously treated textile layer, leading to the formation of chemical bonds between the intermediate polymer layer and the metal-coating layer that is formed;

wherein the chemical bonds between the coupling polymer and the metal-coating layer are provided by means of M-OH functions carried by the intermediate polymer layer or by O-M-O covalent bridges, where M=Al, Zr, Ti, Cr or Si.

15. The method according to claim 14, wherein the method includes a step of chemically cleaning the first matrix, said step consisting in applying a solution or a dispersion comprising a surfactant or a mixture of surfactants on the first matrix, this cleaning step taking place prior to step b) on the non-sized first matrix, or together with step b), with the surfactant(s) then being added to the solution or the dispersion in step a).

16. The method according to claim 14, wherein the preparation in step a) is an aqueous dispersion made with 1% to 30% coupling agent(s), 50% to 95% polymer(s) with reactive functions, and 0.05% to 1% formulation agent(s), the percentages being expressed for dry extract relative to the total weight of the dry extract corresponding to the prepared dispersion.

17. The method according to claim 16, wherein the coupling agent(s) is/are selected from: silanes; titanates; zirconates; aluminates; blocked isocyanates; and organochromium complexes.

18. The method according to claim 16, wherein the coupling agent(s) is/are selected from organosilanes carrying one to three OH or alkoxy functions, and at least one organic portion R possessing a function enabling covalent grafting on the polymer with reactive functions and/or on the first matrix and/or on the metal-coating layer.

19. The article according to claim 4, wherein said at least one polymer mixed with at least one plasticizer is a polyvinyl chloride.

20. The article according to claim 1, wherein M=Si.

21. The article according to claim 1, wherein the at least one plasticizer comprises a phthalate.

* * * * *